United States Patent [19]

Wendt

[11] 4,360,139

[45] Nov. 23, 1982

[54] HIGH SPEED SHEET FEEDING APPARATUS

[75] Inventor: Michael Wendt, Hope, Mich.

[73] Assignee: Lyle Development, Inc., Beaverton, Mich.

[21] Appl. No.: 222,058

[22] Filed: Jan. 2, 1981

[51] Int. Cl.[3] ..... B65H 17/26

[52] U.S. Cl. ..... 226/142; 226/158

[58] Field of Search ..... 226/120, 137–142, 226/158–164; 271/139, 140, 267–269; 425/162, 165

[56] References Cited

U.S. PATENT DOCUMENTS

| | | | |
|---|---|---|---|
| 3,073,499 | 1/1963 | Middleton, Jr. et al. | 226/120 |
| 3,346,923 | 10/1967 | Brown et al. | 425/162 |
| 3,650,449 | 3/1972 | Mundus | 226/142 |
| 3,758,011 | 9/1973 | Portmann | 226/142 |
| 4,011,978 | 3/1977 | Lehmacher et al. | 226/142 |

*Primary Examiner*—Leonard D. Christian
*Attorney, Agent, or Firm*—John J. Swartz

[57] ABSTRACT

Sheet feed apparatus for intermittently advancing a sheet, such as a thermoplastic sheet including a frame, sheet engaging mechanism reciprocally mounted on the frame for intermittently advancing the sheet, mechanism for reciprocally moving the sheet engaging mechanism in a to-and-fro path of travel including a stationary shaft and a rotatable shaft concentric with the stationary shaft, a primary crank arm fixed to the moveable shaft for rotation therewith, a secondary crank arm rotatably mounted on the primary crank arm for rotation relative thereto, and mechanism coupling the primary crank arm and the secondary crank arm for rotatably driving the secondary crank arm in a direction opposite the direction of rotation of the primary crank arm.

13 Claims, 8 Drawing Figures

HIGH SPEED SHEET FEEDING APPARATUS

BACKGROUND OF THE INVENTION

1. Field of the Invention

This invention relates to sheet feed apparatus for intermittently advancing a sheet of material, such as a thermoplastic web, and more particularly to high speed sheet feed mechanism including a compound drive crank.

2. Description of the Prior Art

Thermoforming apparatus, such as that illustrated in U.S. Pat. No. 3,346,923 has been provided heretofore for forming three dimensional objects from a generally continuous web of thermoplastic material. Such apparatus includes a heating oven for heating the sheet of material and differential pressure molds for forming a three dimensional article in the web. Trim press apparatus, such as that disclosed in U.S. patent application Ser. No. 142,241, entitled High Speed Trim Press, filed in U.S. Patent Office on Apr. 21, 1980 and assigned to the assignee of the present application, may be provided for subsequently severing the three dimensional articles from the web or sheet.

Apparatus such as that disclosed in the aforementioned patent application Ser. No. 142,241, which is incorporated herein by reference, discloses sheet feed mechanism for advancing the sheet to a trim press. The sheet feed mechanism includes vertically reciprocal sheet engaging fingers which, on a downward stroke incrementally downwardly advance the sheet.

If a conventional flywheel driven crank is utilized to drive the sheet engaging fingers in a to-and-fro path, the speed of operation is restricted because of the substantial mass of the conventional flywheel driven crank arm. At certain high speeds, such conventional flywheel driven crank arms also impart vibration to the machine. Accordingly, it is an object of the present invention to provide a new and novel high speed feed mechanism for advancing a sheet, such as a thermoplastic sheet.

Another object of the present invention is to provide a crank operated sheet feed system which reduces the imbalance otherwise set up with a conventional crank drive.

A conventional crank arm requires a relatively large "window" in which to complete its movement. Accordingly, it is an object of the present invention to provide a compound crank which operates within a reduced "window".

Yet another object of the present invention is to provide a high speed sheet feed apparatus comprising a compound crank including a pair of pivotally coupled crank arms which rotate between co-extensive or folded positions and longitudinally extended positions.

It is another object of the present invention to provide high speed sheet feed apparatus of the type described including sheet engaging mechanism which moves in a to-and-fro path to advance a sheet and mechanism for driving the sheet engaging mechanism including a stationary shaft, a movable, concentric shaft rotatably mounted on the stationary shaft, a crank arm fixed to the movable shaft, a secondary crank arm rotatably mounted on the primary crank arm, mechanism coupling the primary and secondary crank arms for concurrent rotary movement in opposite directions, and mechanism for pivotally coupling the secondary crank arm to the sheet engaging mechanism.

Still another object of the present invention is to provide high speed sheet feed apparatus comprising a compound crank drive including a rotatable primary crank arm and a secondary crank arm rotatably mounted on the primary crank arm for orbital movement therewith and for rotating motion relative thereto at a velocity equal to twice the rotational velocity of the primary crank arm.

Another object of the present invention is to provide high speed compound crank sheet feed apparatus which will decrease the cost of tooling.

Variations in the dimensions of the plastic sheet, and in particular foam sheets, due to temperature differentials and the like, sometimes results in nonuniform spacing between the articles formed in the sheet. Accordingly, it is an object of the present invention to provide compound crank sheet feed apparatus including mechanism for incrementally adjusting the crank mechanism to accurately align the articles to be trimmed with a work station, such as the trim station of a trim press.

Other objects and advantages of the present invention will become apparent to those of ordinary skill in the art as the description thereof proceeds.

SUMMARY OF THE INVENTION

Sheet feed apparatus for intermittently incrementally indexing a continuous web, such as a plastic sheet, through a machine, such as a trim press comprising: a frame; sheet engaging mechanism; mechanism reciprocally mounting the sheet engaging mechanism on the frame for movement in a to-and-fro path of travel for intermittently forwardly indexing the sheet on its forward path of travel but permitting the sheet to remain stationary on its reverse path of travel; and mechanism for reciprocably driving the mounting mechanism in a to-and-fro path comprising: a first shaft fixed to the frame; a second shaft, concentric with the first shaft, rotatably mounted on the first shaft; mechanism for rotatably driving the second shaft; a first sprocket wheel fixed to the first shaft; a primary crank arm fixed to the second shaft for rotation therewith, a secondary crank arm, rotatably mounted on the primary crank arm for orbital movement therewith and for rotating movement relative thereto; a second sprocket wheel, fixed to the second crank arm; and a closed, flexible member trained around the first and second sprocket wheels for rotatably driving the second crank arm in a direction of rotation opposite the direction of rotation of the first crank arm as the first crank arm is rotatably driven.

BRIEF DESCRIPTION OF THE DRAWINGS

This invention shall hereafter be more fully disclosed with reference to the accompanying drawings in which.

DESCRIPTION OF THE PREFERRED EMBODIMENT

Figure 5:
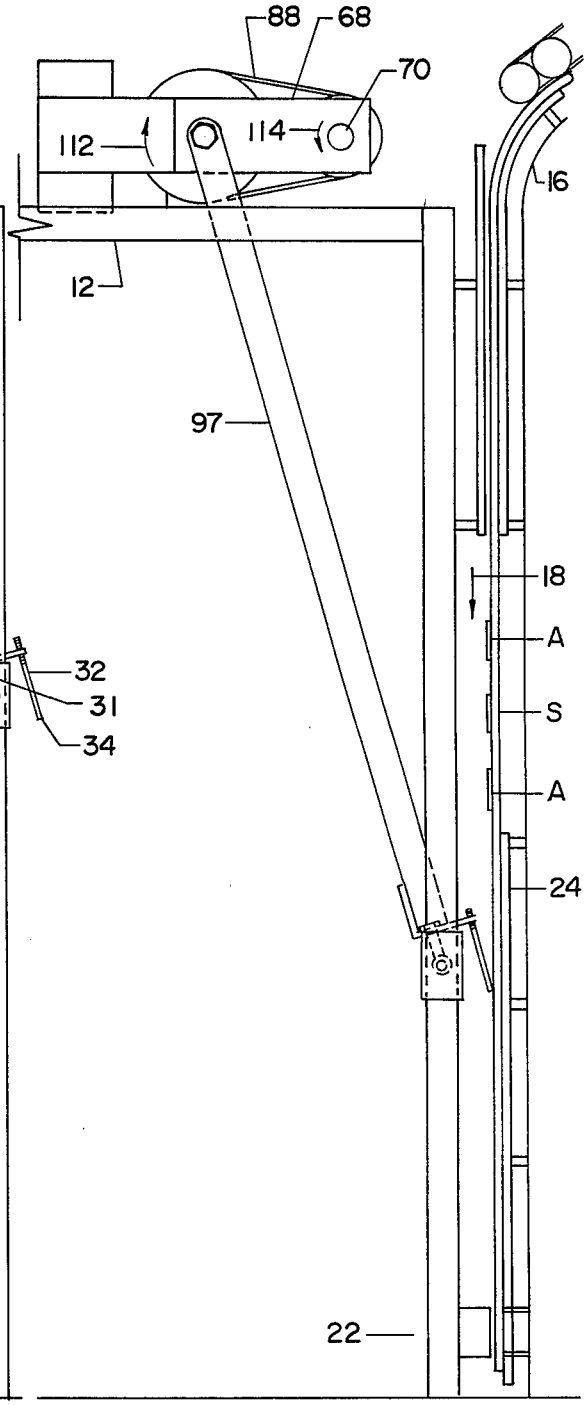

Apparatus constructed according to the present invention, generally designated 10, includes a frame, generally designated F, including upright posts, generally designated 14, spanned by laterally spaced side frame members 12 and transversely extending frame members 13. A sheet, generally designated S, of thermoplastic material having articles A differentially pressure formed therein, is mounted on a curvilinear frame supported guide, generally designated 16, (FIG. 5) for movement in an up and over and thence a vertically downward path represented by the arrow 18 to a trim station, generally designated 22, (FIG. 5) where the articles A are trimmed or severed from the sheet S. The sheet S passes along a frame supported backing plate 24. The backing plate 24 and the curvilinear guide structure 16 are more particularly described in the aforementioned patent application.

Figure 8:
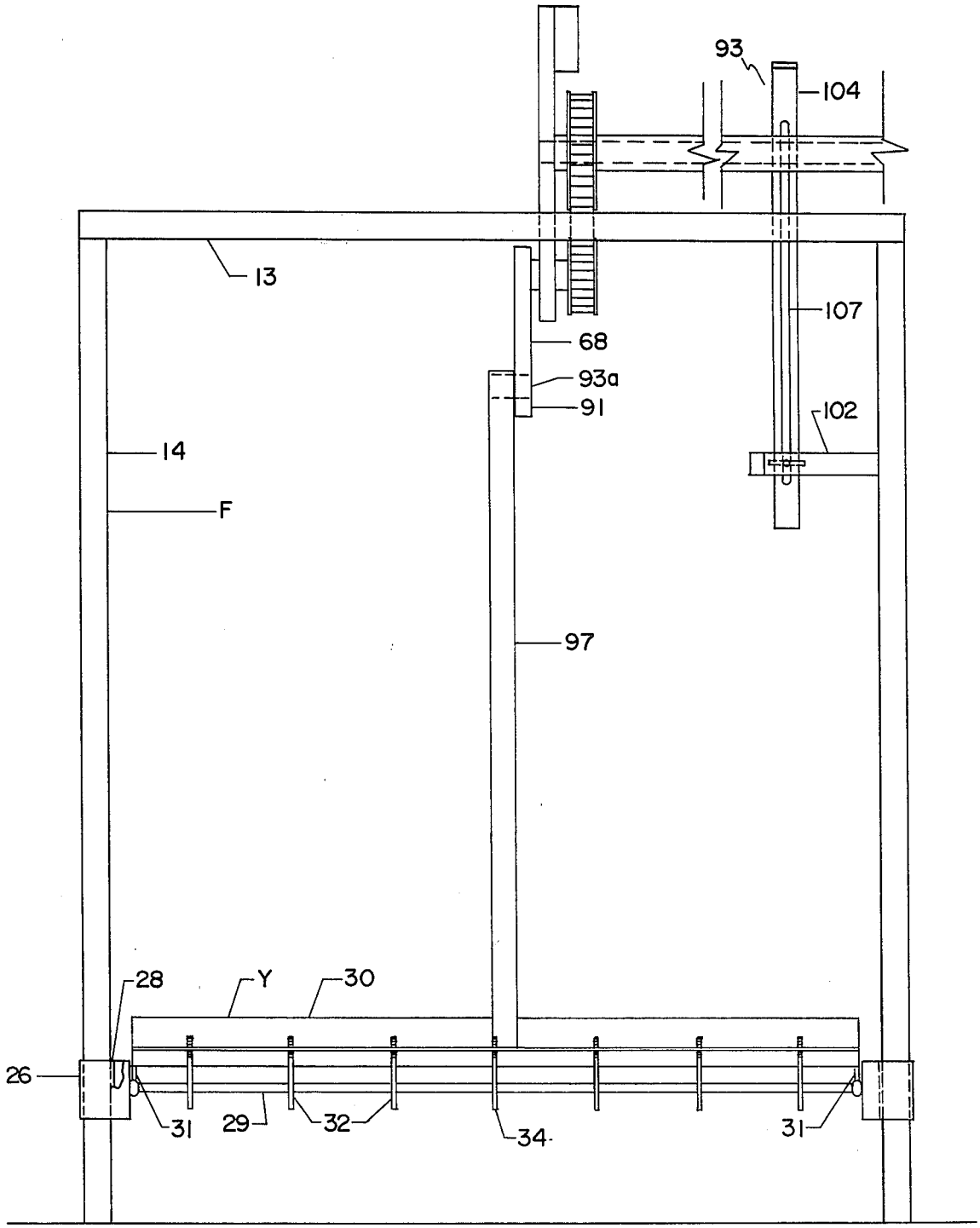
FIG. 8 is a fragmentary front elevational view more particularly illustrating the sheet engaging fingers.

The sheet feed apparatus 10 includes a pair of sleeves 26 (FIG. 8) slideably mounted for vertical movement on the upstanding posts 14 via bushings 28. A crossbar 29 spans the sleeves 26 and pivotally mounts a yoke Y via a pair of laterally spaced pivotal links 31. The yoke Y includes a crossarm 30 mounting a plurality of laterally spaced apart, sheet engaging, flexible fingers 32 which include terminal edges 34 that "bite" the sheet S and move it downwardly in the direction of the arrow 18. As the fingers 32 move upwardly in a manner to be immediately described to the position illustrated in FIG. 5, the fingers 32 merely escape along the outer surface of the sheet 18.

Apparatus, generally designated 36, is provided for vertically reciprocally moving the mounting bar 30 and sheet engaging fingers 32 in a reciprocal vertical path and includes a frame supported anchor bar 38 fixed at one end thereof to one end 41*a* of hollow, cylindrical, stationary transverse outer shaft 40. The opposite end 42 of the hollow tubular shaft 40 is fixed to a sprocket wheel 44 having a plurality of sprocket teeth 46 about the circumference thereof for a purpose to become apparent. The shaft 40, although incrementally rotatable with anchor bar 38, about its axis 41 as will become apparent, will sometimes hereinafter be referred to as a "stationary" shaft.

A rotatable primary shaft 48 is journaled, via tapered roller bearings 50, in the hollow tubular stationary shaft 40. The stationary shaft 40 and rotatable shaft 48 are concentric about a common axis 41. A drive sprocket wheel 52 is mounted on the primary shaft 48 for rotation therewith via a drive flange 54, a nut 56 threadedly received on the end of shaft 48, and a jam nut 58. A drive chain 53 is trained around the drive sprocket wheet 52, a pair of idler sprocket wheels 55 rotatably mounted on the anchor bar 38, and a drive sprocket wheel (not shown) which is driven by a motor or the like. The drive flange 54 is coupled to the shaft 48 via a key 60. Fixed to the opposite end 62 of the rotating primary shaft 48 via a pin 66 is a primary crank arm 64.

A secondary crank arm 68 is fixed to a pivot pin 70 journaled on the terminal end of the primary crank arm 64 via tapered roller bearings 72 provided with a seal ring 74 and a bearing spacer 76. A circumferential grease seal 78 is provided as illustrated.

A satelite sprocket wheel 80 is fixed to the inner end of the crank pin 70 via a key 82 in radial alignment with the sprocket wheel 44. The sprocket wheel 80 has teeth 84 about the circumference thereof. The number of teeth 84 is equal to one-half the number of teeth 46 on the "fixed" sprocket wheel 44. An endless flexible timing belt 86, having internal teeth or cogs 88 thereon, is trained around the fixed sprocket wheel 44 and the rotatable sprocket wheel 80. The sprocket wheel 80 is secured on the crank pin 70 via a lock nut 90 threadedly received by the pivot pin 70.

A counter balance 92 is fixed to the opposite end 94*a* of the primary crank arm 64 to counter balance the rotating mass mounted on the primary crank arm 64.

The outer terminal end 91 of the secondary crank arm 68 is pivotally coupled, via a pivot pin 93*a*, to a coupling rod 97 which is fixed, at its lower end to the finger mounting cross arm 30.

Figures 6, 7:
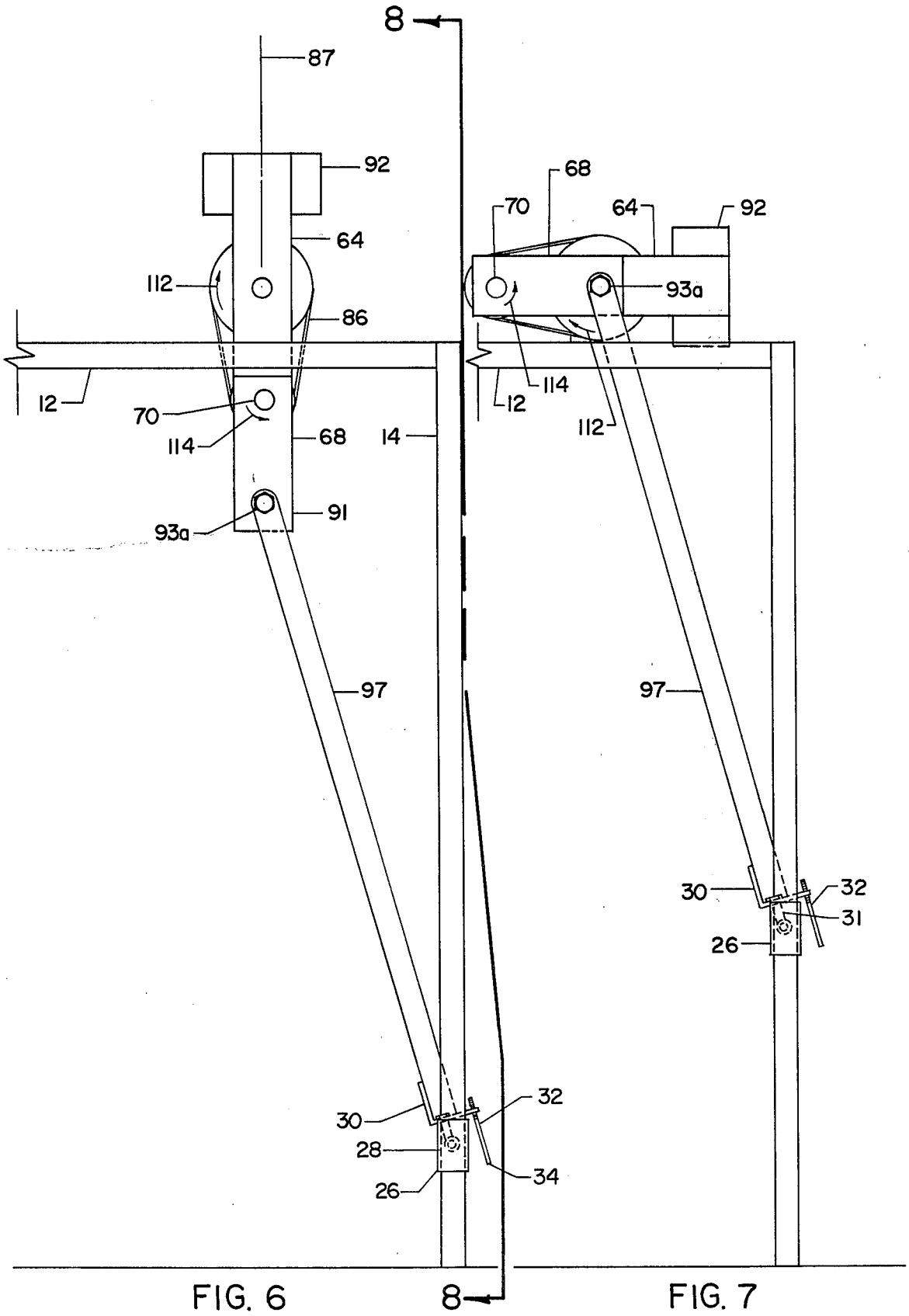

If the relative lengths of arms 64 and 68 such that the distance between the axis of pivot pin 93*a* and the axis of pivot pin 70 is equal to the distance between the axis of pivot pin 70 and the axis 41 of the rotatable shaft 48 and when the parts are positioned as illustrated in the drawings, the axis of pivot pin 93*a* will move in a to-and-fro vertical path of travel, represented by the line 87. (FIG. 6)

The tubular outer shaft 40 may be rotatably indexed about the axis 41 via the anchor bar 38, in a manner to be immediately described, so that the to-and-fro path of the axis of pin 93 will move in a vertically inclined path of travel instead of the vertical path of travel represented by the line 87.

Apparatus, generally designated 93, is provided for adjusting the angular position of the shaft 40 relative to the axis 41. The apparatus 93 includes a threaded rod 94 which is freely journaled via a sleeve 95 mounted in a bearing block 96 which has a pin 99 thereon rotatably received by the anchor bar 38.

The threaded rod 94 is threadedly received by a nut 100 which is pivotally mounted, via pivot pin 101, in a frame supported clevis 102. The anchor bar 38 is releasably fixed in position via a curvilinear anchor strap 104 which is attached at its upper end to the anchor bar 38 via a bolt 105 and is slidably received in a frame supported U-shaped guide 106 for sliding movement therein.

The anchor strap 104 includes an elongate slot 107 therein which receives the terminal end of a clamp screw 108 which is adjusted by a handle 109. The clamp bolt it threadedly received in a nut 111 fixed to the U-shaped guide 106. When the handle 109 is turned inwardly, it will clamp against the anchor strap 104 to anchor the strap 104 and thus the shaft 40 in any selected one of a plurality of different positions.

When the bolt 108 is unturned, a handle 110, fixed to the lower end of the threaded bolt 94, can be manually rotated to swing the anchor bar 38 and thus the shaft 40 about the axis 41. When the proper adjusting is made, the bolt 108 is again turned inwardly to clamp the curvilinear anchor bar plate 104 in position.

When the anchor bar 38 is rotatably adjusted, the positions of the idler sprocket wheels 55, which are mounted thereon, will also be adjusted.

The movement of the two idler sprocket wheels 55 permits continued operation of the feed system in time with the trim press when the stroke is adjusted.

The idler sprockets compensate for the adjustment of the anchor bar and the stroke so that the machine does not get out of time with the feed of the sheet.

THE OPERATION

The chain 53 is driven to rotate the primary shaft 48, within the secondary stationary shaft 40, and drive the primary crank arm 64 in the direction represented by the arrow 112. As the crank arm 64 rotates clockwise, in the direction of the arrow 112, the timing belt 86 reacts between the stationary sprocket wheel 44 and the movable sprocket wheel 80 to drive the crank pin 69 and swing the secondary arm 68 in the opposite clockwise direction, represented by the arrow 114 (FIGS. 4–7). There are twice the number of sprocket teeth 46 on the sprocket wheel 44 as there are sprocket teeth 84 on the sprocket wheel 80 so that the rotational velocity of the secondary crank arm 68 about the axis pin 70 will be twice the rotational velocity of the primary crank arm 64 about the axis 41.

The terminal end 91 of the secondary crank arm 68 will move in a vertical path of travel represented by the line 87. It will be assumed that the primary crank arm 64 and the secondary crank arm 68 are initially in the fully upwardly extended positions illustrated in FIG. 4 in which the primary and secondary arms 64, 68 are generally longitudinally vertically aligned and fully extended upwardly such that the sheet engaging fingers 32 are positioned at the upper ends of their stroke of their travel. As the primary crank arm 64 rotates 90 degrees about axis 41, the secondary crank arm which orbits with crank arm 64, will rotate 90° in the opposite direction about the axis of pin 70. At this time, the primary and secondary crank arms 64, 68 will be "folded" to the positions illustrated in FIG. 5 and the sheet engaging fingers 32 will have downwardly moved through one-half of their stroke. As the primary crank arm 64 rotates and additional 90° to complete one-half revolution, the arm 68 rotates an additional 90° so that the arms 64 and 68 are in the fully downwardly extending positions illustrated in FIG. 6 in which the primary and secondary crank arms 64, 68 are generally longitudinally vertically aligned and the sheet engaging fingers 32 are at the lower ends of their stroke.

Figure 1:
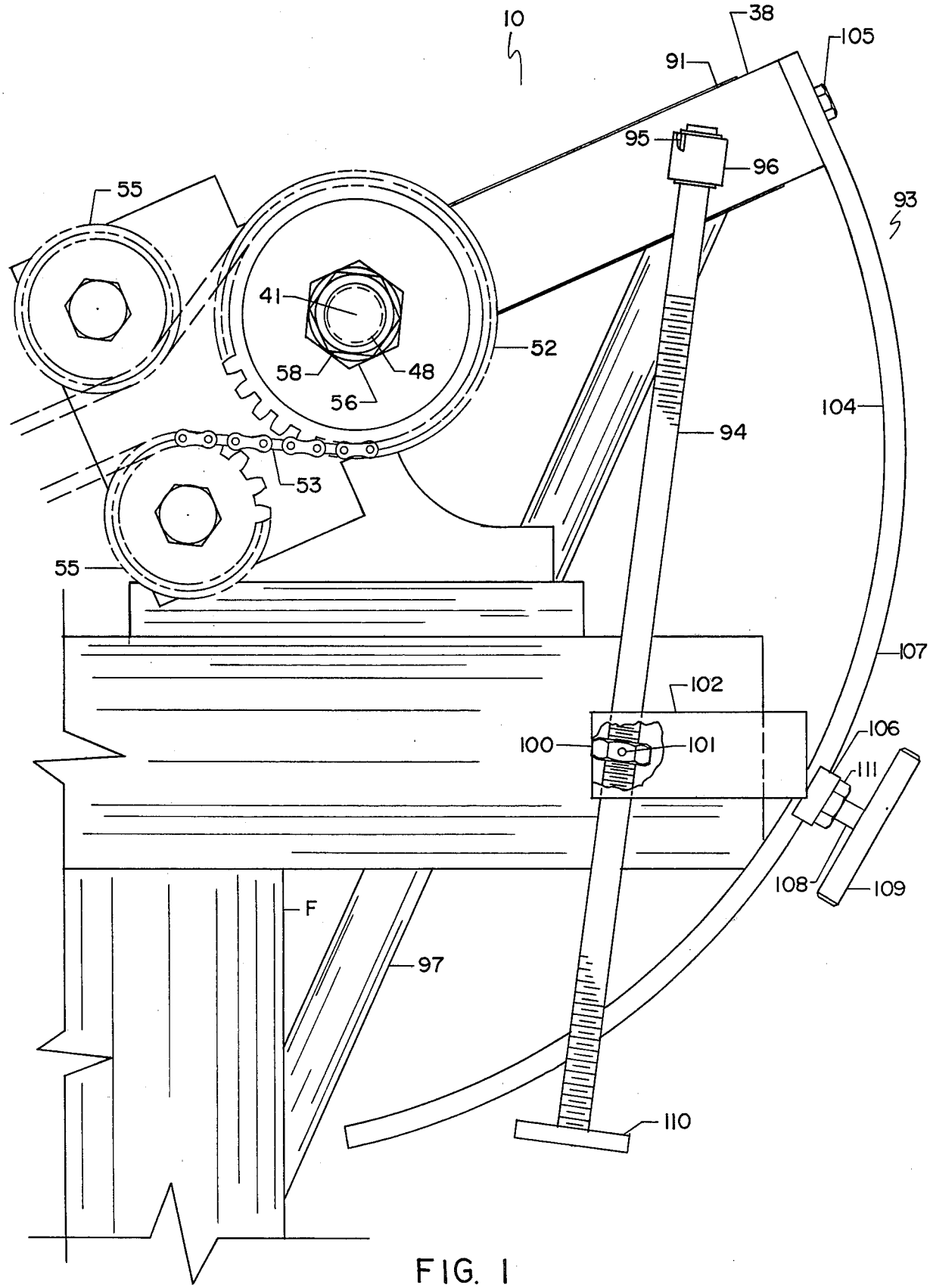
FIG. 1 is a side elevational view, illustrating apparatus constructed according to the present invention taken along the line 1—1 of FIG. 3.
Figure 2:
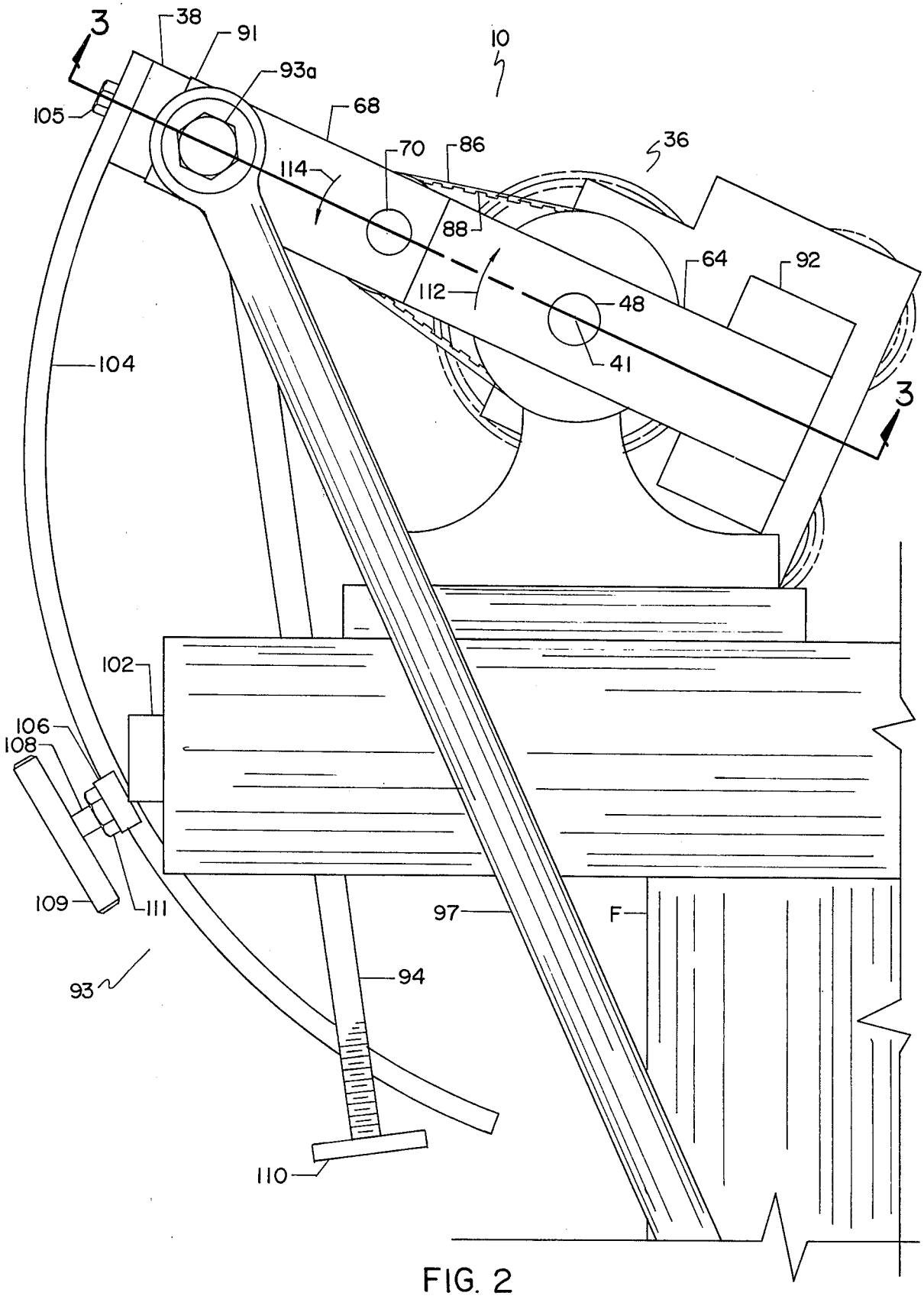
FIG. 2 is an opposite side elevational view, taken along the line 2—2 of FIG. 3.
Figure 3:
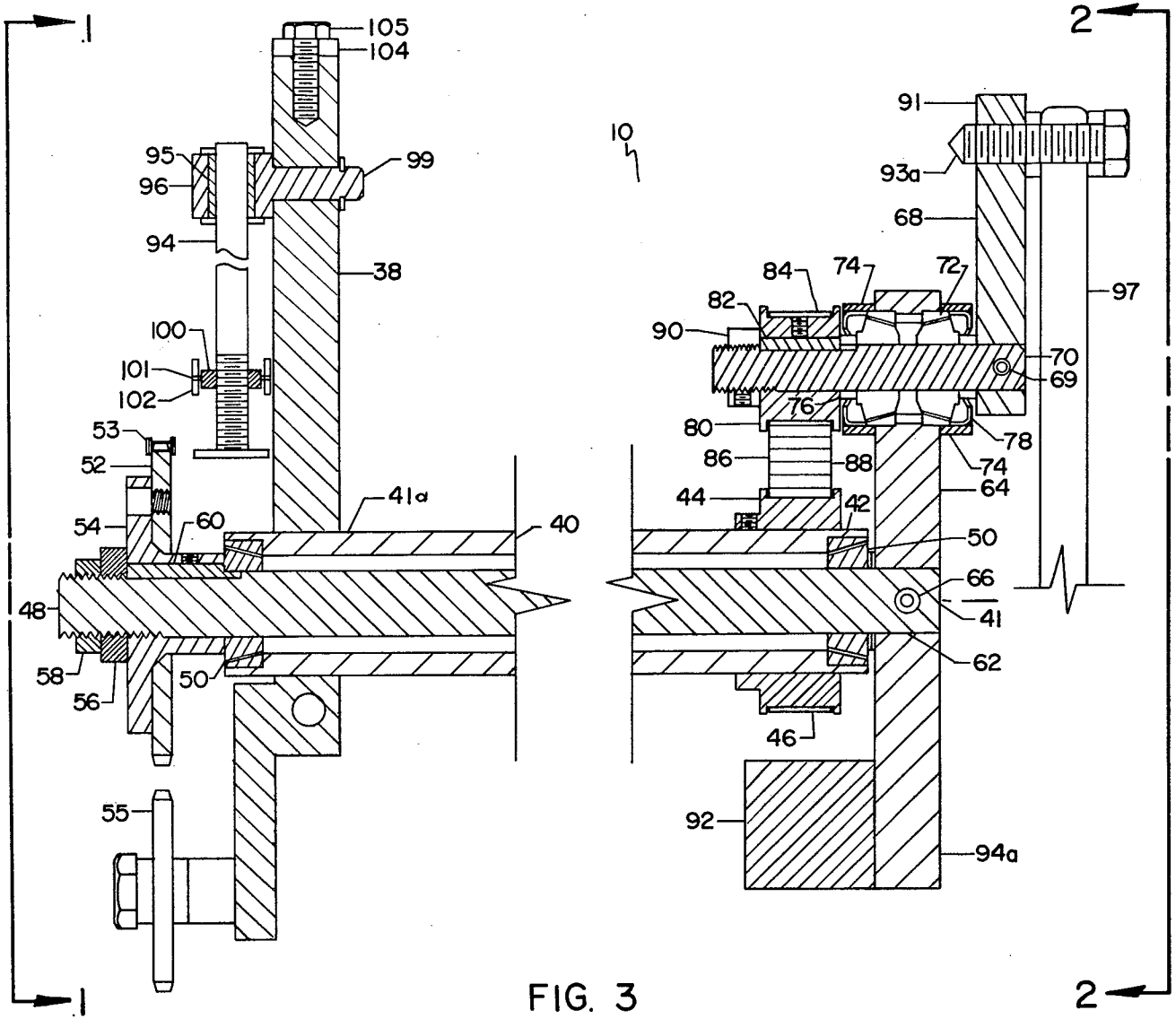
FIG. 3 is a sectional view, taken along the line 3—3 of FIG. 2.
Figure 4:
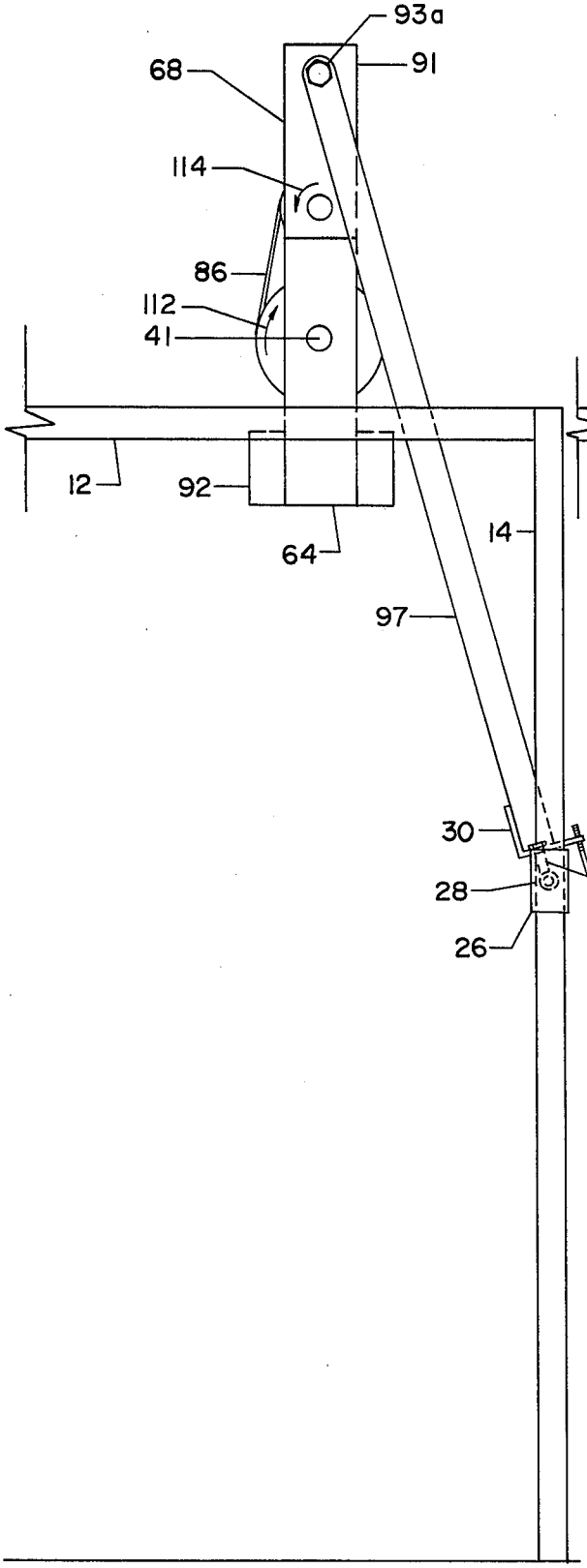
FIGS. 4–7 are side elevational views illustrating portions of the apparatus in various sequential positions during an operational sequence.

When the crank arms 64 and 68 move between the positions illustrated in FIG. 4 and the positions illustrated in FIG. 6, the sheet gripping fingers 32 will "bite" the sheet S and index it downwardly. As the crank arm 64 continues to rotate clockwisely another 90 degrees from the position illustrated in FIG. 6 to the position illustrated in FIG. 7, the secondary crank arm 68 will be rotated clockwisely another 90 degrees to a "folded" position or a position co-extensive with the primary crank arm 64. The crank arms 64, 68 will then continue to rotate and return to the positions illustrated in FIG. 4, when the crank arms 64, 68 move from the positions illustrated in FIG. 6 to the positions illustrated in FIG. 8, the sheet gripping fingers 32 move upwardly and the sheets will not be advanced. The operation will continue to incrementally downwardly index the sheet.

In the event that the stroke of the sheet gripping fingers requires adjustment, the angular position of the stationary shaft 40 can be angularly adjusted relative to the position of the rotating shaft 48. This will adjust the angular position in which the primary and secondary crank arm 64, 68 reach their fully extended positions. Such adjustment is accomplished by releasing the clamp screw 108 and manually turning the threaded rod 94 via handle 110 in the appropriate direction. When the adjustment is completed, the clamp screw 108 is again turned to clamp the attaching plate 104 to the frame. The stroke can thus be adjusted without interrupting operation of the machine.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Sheet feed apparatus for intermittently feeding a continuous sheet, such as a plastic sheet to a work station of a machine, such as a trim press, comprising;

a frame;

sheet engaging means;

means reciprocally mounting said sheet engaging means on said frame for movement in a forward and reverse path of travel to intermittently forwardly index said sheet as said sheet engaging means moves forwardly but permitting said sheet to remain stationary as said sheet engaging means moves rearwardly; and means for reciprocally driving said mounting means in said forward and reverse path of travel comprising;

a first shaft mounted on said frame;

a second shaft, concentric with said first shaft, rotatably mounted on said first shaft;

means for rotatably driving said second shaft;

a first sprocket wheel fixed to said shaft;

a primary crank arm fixed to said second shaft for rotation therewith;

a second crank arm mounted on said primary crank arm for orbital movement therewith and for rotating movement relative thereto;

a second sprocket wheel fixed to said second crank arm;

endless means trained around said first and second sprocket wheels for rotatably driving said second crank arm in a direction of rotation opposite the direction of rotation of said first crank arm;

and drive arm means, journaled on said secondary crank arm and coupled to said mounting means, for reciprocally driving said sheet engaging means in said to-and-fro path of travel to intermittently forwardly index said sheet.

2. The sheet feed apparatus set forth in claim 1 including means for adjusting the stroke of said drive arm means during operation of said sheet feed apparatus.

3. The sheet feed apparatus set forth in claim 2 wherein said stroke adjusting means includes means for rotatably adjusting the position of said first shaft and said first sprocket wheel.

4. The apparatus set forth in claim 2 wherein said drive arm means comprises:

a first coupling rod having one end pivotally coupled to said secondary crank arm and a second end pivotally coupled to said reciprocal mounting means.

5. The apparatus set forth in claim 4 wherein said stroke adjusting means includes an anchor bar; means for said frame for adjusting the position of said anchor bar; and means for releasably coupling said anchor bar to said frame.

6. The apparatus set forth in claim 4 wherein said secondary crank arm is pivotally mounted on one end of said primary crank arm; and further including counterbalance means mounted on a portion of said primary crank arm diametrically opposite said end coupled to said first coupling rod for damping vibration.

7. The sheet feed apparatus set forth in claim 6 wherein said first and second sprocket wheels each include a plurality of circumferentially disposed teeth about the periphery thereof; the teeth on said first sprocket being equal to twice the number of teeth on said second sprocket wheel.

8. The sheet feed apparatus set forth in claim 6 wherein said first and second sprocket wheels and said endless means comprise means for revolving said secondary crank arm through one revolution on said primary crank arm for each revolution of said primary crank arm.

9. The sheet feed apparatus set forth in claim 5 wherein said sheet engaging means comprises a plurality of laterally spaced apart sheet engaging fingers mounted on a bar reciprocably movable on said frame.

10. Sheet feed apparatus for intermittently advancing a web, such as a thermoplastic sheet, to a machine such as a trim press for performing an operation, such as trimming, to said sheet comprising:

a frame;

web engaging means;

means mounting said web engaging means on said frame for reciprocal movement in a to-and-fro path of travel;

means for driving said means mounting said web engaging means to a to-and-fro path including:

first and second concentric coaxial shafts mounted on said frame;

means mounting one of said shafts on said frame;

means journalling the other of said shafts for rotation on said one shaft;

means for rotatably driving said other shaft;

primary crank arm means fixed to said other shaft for rotation therewith;

secondary crank arm means mounted on said primary crank arm means for orbital movement therewith and for rotational movement about a second axis, relative thereto;

means coupling said primary crank arm means and said secondary crank arm means for rotating said secondary crank arm means about said second axis at a rotational velocity which is twice the rotational velocity of said primary crank arm means about the first axis.

11. The sheet advancing apparatus set forth in claim 10 wherein said coupling means includes first sprocket wheel fixed to said other shaft, a second sprocket wheel fixed to said secondary crank arm, and endless means trained around said first and second sprocket wheels to drive said secondary crank arm in a direction of rotation opposite the direction of rotation of said primary crank arm.

12. The sheet advancing apparatus set forth in claim 11 wherein means is provided for securing said one shaft in any selected one of a plurality of different rotary positions about said one axis.

13. The sheet advancing apparatus set forth in claim 12 wherein said securing means includes an anchor bar fixed to said one shaft; a threaded rod; rod mounting means, pivotally mounted on said anchor bar, journalling said threaded rod for rotation thereon; threaded means on said frame threadedly receiving said threaded rod; and means for releasably clamping said anchor bar to said frame in any selected one of a plurality of different position.

* * * * *